US008403074B2

(12) United States Patent
Yin

(10) Patent No.: US 8,403,074 B2
(45) Date of Patent: Mar. 26, 2013

(54) OUTPUT DEVICE FOR POWER TOOL HAVING PROTECTION MECHANISM

(75) Inventor: Hsin-Chieh Yin, Jhongli (TW)

(73) Assignee: Trinity Precision Technology Co., Ltd., Toufen Township (TW)

( * ) Notice: Subject to any disclaimer, the term of this patent is extended or adjusted under 35 U.S.C. 154(b) by 266 days.

(21) Appl. No.: 12/976,025

(22) Filed: Dec. 22, 2010

(65) Prior Publication Data

US 2012/0037388 A1 Feb. 16, 2012

(30) Foreign Application Priority Data

Aug. 10, 2010 (TW) ..... 99215307 U

(51) Int. Cl.
*B25B 17/00* (2006.01)

(52) U.S. Cl. ..... 173/47; 173/48

(58) Field of Classification Search ..... 173/47, 173/48, 162.1, 162.2
See application file for complete search history.

(56) References Cited

U.S. PATENT DOCUMENTS 6,142,242 A * 11/2000 Okumura et al. ..... 173/48
6,230,819 B1 * 5/2001 Chen ..... 173/48
6,688,406 B1 * 2/2004 Wu et al. ..... 173/48
6,892,827 B2 * 5/2005 Toyama et al. ..... 173/48
2005/0150669 A1 * 7/2005 Umemura et al. ..... 173/48

* cited by examiner

*Primary Examiner* — M. Alexandra Elve
*Assistant Examiner* — Nathaniel Chukwurah
(74) *Attorney, Agent, or Firm* — Wang Law Firm, Inc.; Li K. Wang; Stephen Hsu

(57) ABSTRACT

An output device for a power tool includes an output unit, a stationary ratchet gear unit, a spring disposed between the output shaft unit and the stationary ratchet gear unit, a locking member having pawls, a case accommodating the aforementioned parts and a control device threadedly connected to the case. The output unit includes an output shaft with a first bearing and a movable ratchet gear which have movable ratchet teeth facing stationary ratchet teeth of a stationary ratchet gear. The stationary ratchet gear includes ribs and each rib has an inclined surface. When the pawls are not engaged with the ribs, the output shaft can outputs power in a form of rotation in both directions. When the pawls are engaged with the ribs, the output shaft outputs power in a form of rotation in a forward direction combined with vibration or rotation in a reverse direction without vibration.

2 Claims, 4 Drawing Sheets

OUTPUT DEVICE FOR POWER TOOL HAVING PROTECTION MECHANISM

BACKGROUND OF THE INVENTION

1. Field of the Invention

The present invention relates generally to an output device for a power tool which can output pure rotation, rotation in the forward direction and axial vibration or rotation in the reverse direction without axial vibration, so as to protect a ratchet gear of the output device from damage.

2. The Prior Arts

A conventional power tool, such as a power drill, generally outputs power from the motor to the output shaft by the gear unit. Besides, in order to tighten the bolts or to loosen the bolts, some power tools are equipped with an axial vibration function which can output an impact force to tighten the bolts or loosen the bolts.

The conventional impact power tool with the vibration function generally comprises an output shaft, a stationary ratchet gear and a movable ratchet gear mounted to the output shaft, at least one block located between the stationary ratchet gear and the movable ratchet gear, a case for accommodating the parts mentioned above, and an adjusting knob which is threadedly connected to the case. The stationary ratchet gear is cooperated with a bearing and located within the case and is rotatable relative to the case. The movable ratchet gear is fixed to the output shaft and is co-rotated with the output shaft. When the adjusting knob is rotated in the forward direction or the reverse direction, the block is controlled to move axially toward the front end or the rear end of the case so as to control the protrusions on the block to be engaged with or disengaged from the ribs on the stationary ratchet gear. When the protrusions are not engaged with the ribs and the output shaft is applied by an axial force to engage the movable ratchet gear with the stationary ratchet gear, because the stationary ratchet gear is free to rotate, the output shaft driven by the power source device provides the output in the form of pure rotation. When the protrusions are engaged with the ribs and the output shaft is applied by the axial force to engage the movable ratchet gear with the stationary ratchet gear, because the stationary gear is fixed, so that the power source device drives the output shaft to rotate and the ratchet teeth on the movable ratchet gear are forced to move over the ratchet teeth on the stationary ratchet gear. By the interference, the output shaft outputs axial vibration.

The disadvantages of the conventional design is that when the protrusions of the block are engaged with the ribs of the stationary ratchet gear, the output shaft is applied by the axial force and rotates in the reverse direction (restricted direction of the ratchet teeth), the movable ratchet teeth and the stationary ratchet teeth will catch against the steeply sloped edges of the teeth. The mechanical stress is very high and therefore the movable ratchet teeth and the stationary ratchet teeth are very likely to break.

SUMMARY OF THE INVENTION

A primary objective of the present invention is to provide an output device for a power tool which overcomes the disadvantage of the conventional designs and protect parts of the device from damage due to the stress. The output device has ratchet gears. When the output shaft is rotated in the forward direction (unrestricted direction of the ratchet teeth), the output modes of the power tool include pure rotation and rotation combined with vibration in the axial direction. When the output shaft is rotated in the reverse direction (restricted direction of the ratchet teeth), the axial vibration function is automatically released and the output mode includes pure rotation only so as to protect the inner parts of the output device.

The characteristic of the present invention is that an output device for a power tool includes a protection mechanism to protect the inner parts of the output device. The output device comprises a stationary ratchet gear having multiple ribs and each rib includes an inclined surface, and a locking member having at least one pawl. A control device controls the pawl to be engaged with or disengaged from the ribs of the stationary ratchet gear. When the pawl is not engaged with the ribs of the stationary ratchet gear, the stationary ratchet gear is free to rotate. When an axial force is applied to the output shaft to engage the movable ratchet gear with the stationary ratchet gear, the output shaft outputs power in the form of rotation in the forward direction or the reverse direction. When the pawl of the locking member is engaged with the ribs of the stationary ratchet gear, the stationary ratchet gear is fixed and cannot rotate. In this situation, if an axial force is applied to the output shaft to engage the movable ratchet gear with the stationary ratchet gear and the output shaft is driven to rotate in the forward direction, the movable ratchet teeth of the movable ratchet gear fixed on the output shaft is interfered with the stationary ratchet teeth of the stationary ratchet gear. Therefore, the output shaft outputs rotation in the forward direction and vibration. When the pawl is engaged with the ribs, an axial force is applied to the output shaft to engage the movable ratchet gear with the stationary ratchet gear and the output shaft is driven to rotate in the reverse direction, the pawl engaged with the rib would slip away from the rib along the inclined surface. Thus, the stationary ratchet gear is disengaged from the movable ratchet gear. The stationary ratchet gear is no longer fixed. Therefore, the stationary ratchet gear can rotate with the output shaft and the movable ratchet gear in the reverse direction and without axial vibration. By this protection mechanism, the movable ratchet teeth and the stationary ratchet teeth are protected from damage due to the high stress.

In order to achieve the objective, the output device for a power tool according to the present invention comprises an output unit, a stationary ratchet gear unit, at least one spring disposed between the output shaft unit and the stationary ratchet gear unit, a locking member with pawls, a case for accommodating the parts mentioned above and a control device threadedly connected to the case. The output unit includes an output shaft with a first bearing and a movable ratchet gear which have movable ratchet teeth facing stationary ratchet teeth of the stationary ratchet gear. The stationary ratchet gear includes ribs disposed on a circumferential surface thereof and each rib has an inclined surface. The inclination of the inclined surfaces is smaller than the inclinations of the forward rotation side and the reverse rotation side of the stationary ratchet teeth. Two ends of the spring are in pressed against the output unit and the stationary ratchet gear unit. A switch ring of the control unit is operated to move the locking member along the axial direction of the case so as to control the engagement between the pawls and the ribs. The spring keeps biasing the locking member to maintain the pawls to constantly contact with the ribs so as to smoothly engage the pawls with the ribs.

Preferably, the locking member includes two pawls disposed diametrically opposite to each other and each pawl has an extension extending inward therefrom. The extension may engage with the rib, or slip away from the rib via the inclined surface.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
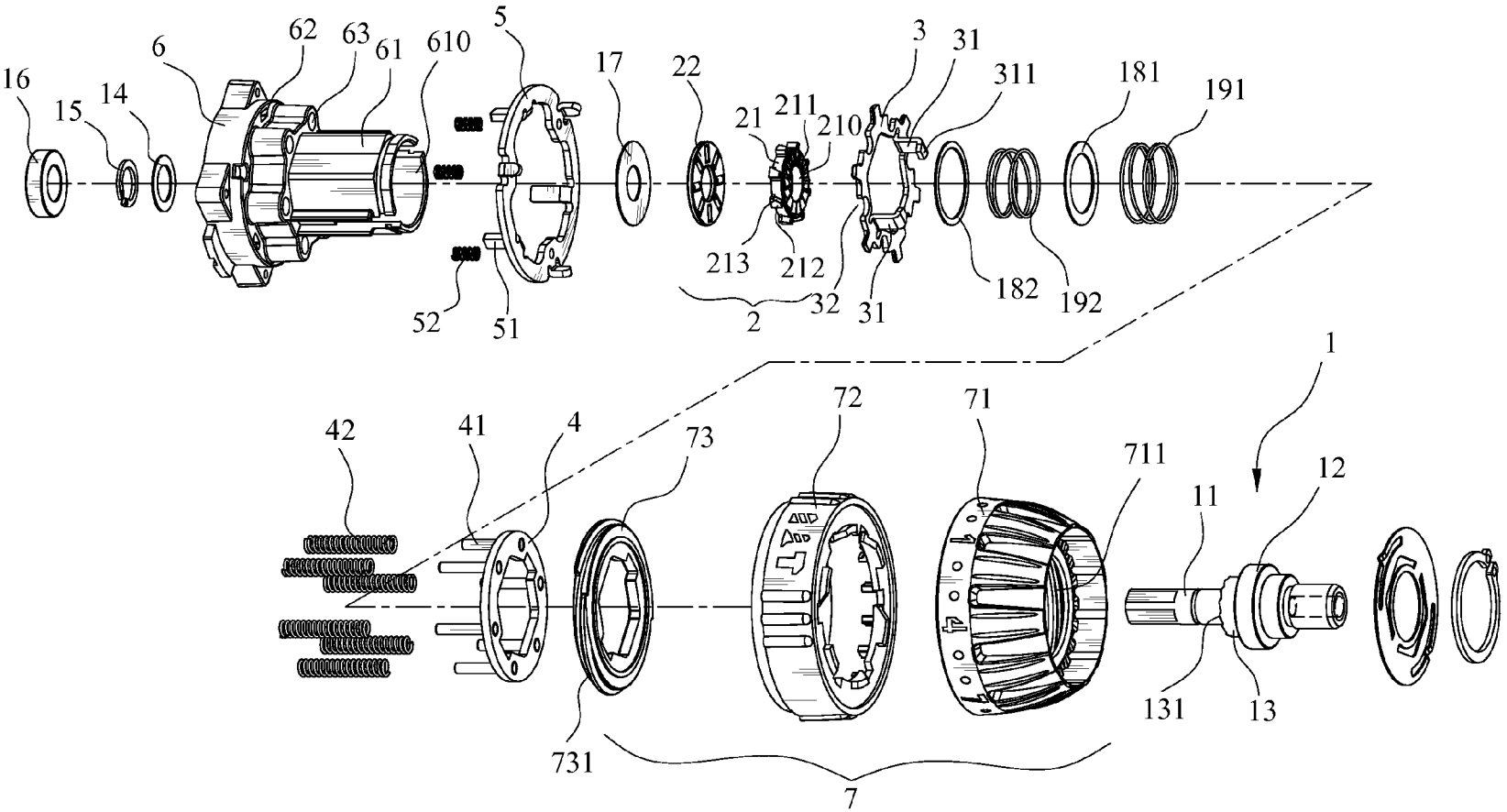
FIG. 1 is an exploded view showing an output device for a power tool which has a protection mechanism in accordance with the present invention.

With reference to the drawings and in particular to FIG. 1, an output device for a power tool which has a protection mechanism in accordance with the present invention can provides output of rotation in the forward direction, rotation in the reverse direction and rotation in the forward direction combined with axial vibration. When the output is switched to rotation in the reverse direction, the axial vibration function is automatically relieved and the output is in the mode of rotation in the reverse direction without axial vibration. Therefore, inner parts of the output device are protected from damage due to the high stress.

With reference to FIG. 1, the output device for the power tool according to the present invention comprises an output unit 1, a stationary ratchet gear unit 2, a locking member 3, a spring washer 4, a positioning washer 5, a case 6 and a control unit 7. The output unit 1 comprises an output shaft 11, a first bearing 12 and a movable ratchet gear 13. The output shaft 11 includes multiple sections with different diameters and the sections include a first section with a larger diameter and a second section with a smaller diameter. The first bearing 12 is connected to the first section of the output shaft 11 and the movable ratchet gear 13 is connected to the second section of the output shaft 11. The movable ratchet gear 13 has a plurality of movable ratchet teeth 131 disposed on a side surface thereof.

The stationary ratchet gear unit 2 comprises a stationary ratchet gear 21 and a second bearing 22. The stationary ratchet gear 21 includes a plurality of stationary ratchet teeth 211 disposed at a side surface thereof facing the movable ratchet teeth 131 and the ribs 212 disposed on the circumferential surface thereof. Each rib 212 has an inclined surface 213 which is located on the same side of each rib 212 and has the same inclination. The inclination of the inclined surfaces 213 is smaller than the inclinations of forward rotation (unrestricted direction) side and reverse rotation (restricted direction) side of the stationary ratchet teeth 211. The stationary ratchet gear 21 has a central hole 210 through which the output shaft 11 extends. The second bearing 22 is a needle roller bearing and has an axial hole.

The integrally formed locking member 3 is pressed to form and then is bended to form L-shaped pawls 31. The two pawls 31 are located diametrically opposite to each other on the locking member 3. The extension 311 is extended inward from the distal end of the pawl 31. The locking member 3 has a plurality of notches 32 defined in a circumferential surface thereof.

The case 6 has a tubular body 61 which has a space 610 to accommodate the parts mentioned above. The first bearing 12 is connected to the inside of the case 6. A plurality of axial positioning holes 62 and recesses 63 are defined in the case 6. The output shaft 11 extends through a first spring 191, a first washer 181, a second spring 192, a second washer 182, the locking member 3, the stationary ratchet gear 21, the second bearing 22, washers 17, 14, and a third bearing 16. All of the parts mentioned above are assembled in the space 610 and the third bearing 16 is secured in an inner periphery of the space 610 and fixed to the output shaft 11 by a clip 15, such that the output shaft 11 is not disengaged from the case 6. After all of the parts are assembled, two ends of the first spring 191 are pressed against the first bearing 12 and the extension 311 of the pawl 31, respective. Two ends of the second spring 192 are pressed against the first bearing 12 and the side surface of the stationary ratchet gear 21, respectively.

The control unit 7 comprises a knob 71, a switch ring 72 and a nut 73. The nut 73 has outer threads 731 and the knob 71 has inner threads 711 which are threadedly connected to the outer threads 731. The positioning washer 5 has a plurality of protrusions 51 extending axially therefrom and the protrusions 51 are inserted into the positioning holes 62 of the case 6. A plurality of springs 52 are disposed between the positioning washer 5 and the case 6. The switch ring 72 and the knob 71 are then connected to the case 6 to let the positioning washer 5 be mechanically connected with the switch ring 72. The knob 71 of the control unit 7 is cooperated with the nut 73, the spring washer 4 and a plurality of torsion springs 42 to adjust the output torque of the output shaft 11. The switch ring 72 is connected to the positioning washer 5 and cooperated with the springs 52 and the locking member 3 to switch the modes of the output power from the output shaft 11. The spring washer 4 includes a plurality of axial rods 41 and each rod 41 is mounted with a torsion spring 42. The spring washer 4 is then mounted to the tubular body 61 of the case 6. The torsion springs 42 are inserted into the recesses 63 of the case 6 to contact with the gears of a power source (not shown).

The distal end of the output shaft 11 is connected to the power source (not shown) located at the rear end of the case 6 and the power source includes a motor and a gear units. When the motor is in operation, the power is transferred to the output shaft 11 through the gear unit. When rotating the knob 71 to adjust the torque output from the output shaft 11, the nut 73 is moved axially in the knob 71 and the spring washer 4 is pushed by the nut 73. When rotating the knob 71 to move the nut 73 to axially push the spring washer 4 to compress the torsion springs 42, the torsion springs 42 apply a force to the gears of the transmission mechanism to slow down the speed of the gears so as to increase the torque. Similarly, if the speed of the gears increases, the output torque reduces. In other words, the output torque is adjusted by adjusting how far the spring washer 4 compresses the torsion spring 42.

Figure 2:
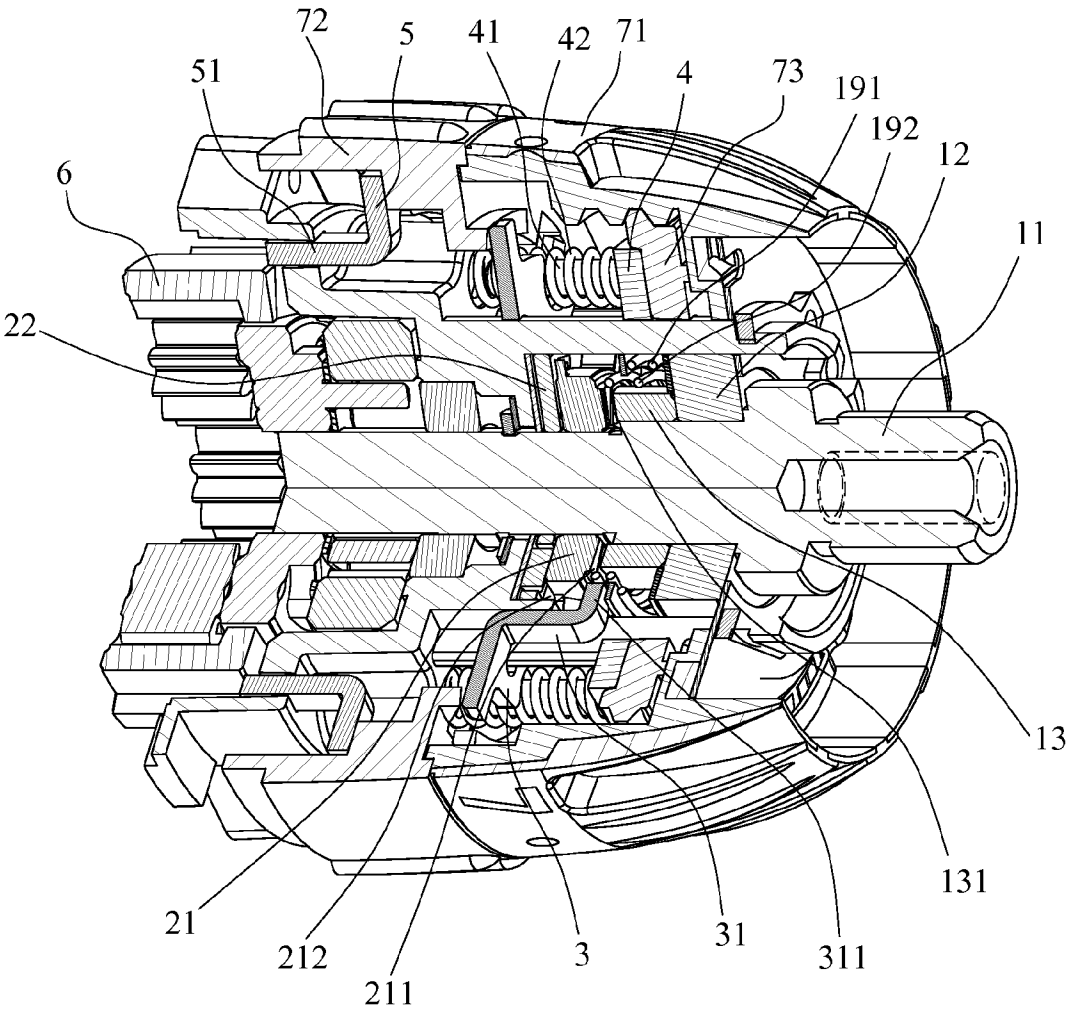
FIG. 2 is a cross-sectional view showing the output device according to the present invention, wherein the output device is switched to be the mode of pure rotation.

The output shaft 11 is adjusted between modes of rotation in the forward direction (unrestricted direction of the ratchet teeth), rotation in the forward direction combined with axial vibration and rotation in the reverse direction (restricted direction of the ratchet teeth) by rotating the switch ring 72. As shown in FIG. 2, the positioning washer 5 and the locking member 3 are mechanically connected to the inside of the switch ring 72. Thus, the switch ring 72 can drive the positioning washer 5 and the locking member 3 to move axially along the tubular body 61 of the case 6. When the switch ring 72 is rotated to a first position, the extensions 311 of the pawls 31 of the locking member 3 are held by the switch ring 72. The extensions 311 of the locking member 3 are not engaged with the ribs 212 of the stationary ratchet gear 21 and therefore the stationary ratchet gear 21 is not fixed. The user applies an axial force to the output shaft 11 and the axial force is toward the case 6. The output shaft 11 is driven to rotate in the forward direction or the reverse direction by the power source, and the movable ratchet teeth 131 on the side surface of the movable ratchet gear 13 are engaged with the stationary ratchet teeth 211 on the side surface of the stationary ratchet gear 21. Thus, by the operation of the movable ratchet gear 13, the stationary ratchet gear 21 is co-rotated with the output shaft 11. The output shaft 11 outputs in the form of pure rotation in both forward and reverse directions.

Figure 3:
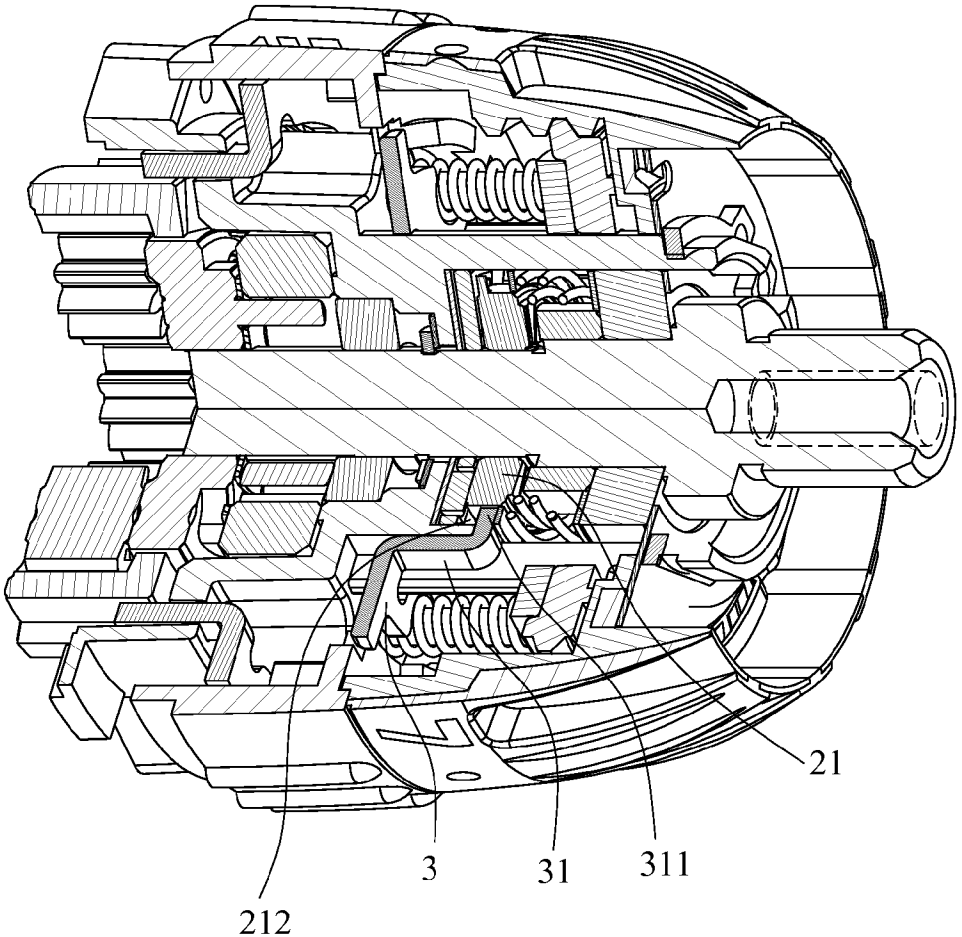
FIG. 3 is a cross-sectional view showing the output device according to the present invention, wherein the output device is switched to be the mode of rotation combined with vibration.

Referring to FIG. 3, when the switch ring 72 is rotated to a second position, the locking member 3 is driven so that the extensions 311 are engaged with the ribs 212. Therefore the stationary ratchet gear 21 is fixed and unable to rotate. The user applies a force to the output shaft 11 and the force is toward the case 6 in the axial direction of the case 6. Although the movable ratchet teeth 131 are engaged with the stationary ratchet teeth 211, the stationary ratchet gear 21 is fixed. Therefore, if the output shaft 11 is driven by the power source to rotate in the forward direction, the movable ratchet teeth 131 are forced to move over the stationary ratchet teeth 211. Due to the interference between the movable ratchet teeth 131 and the stationary ratchet teeth 211, the output shaft 11 rotates in the forward direction and provides an axial vibration.

Figure 4:
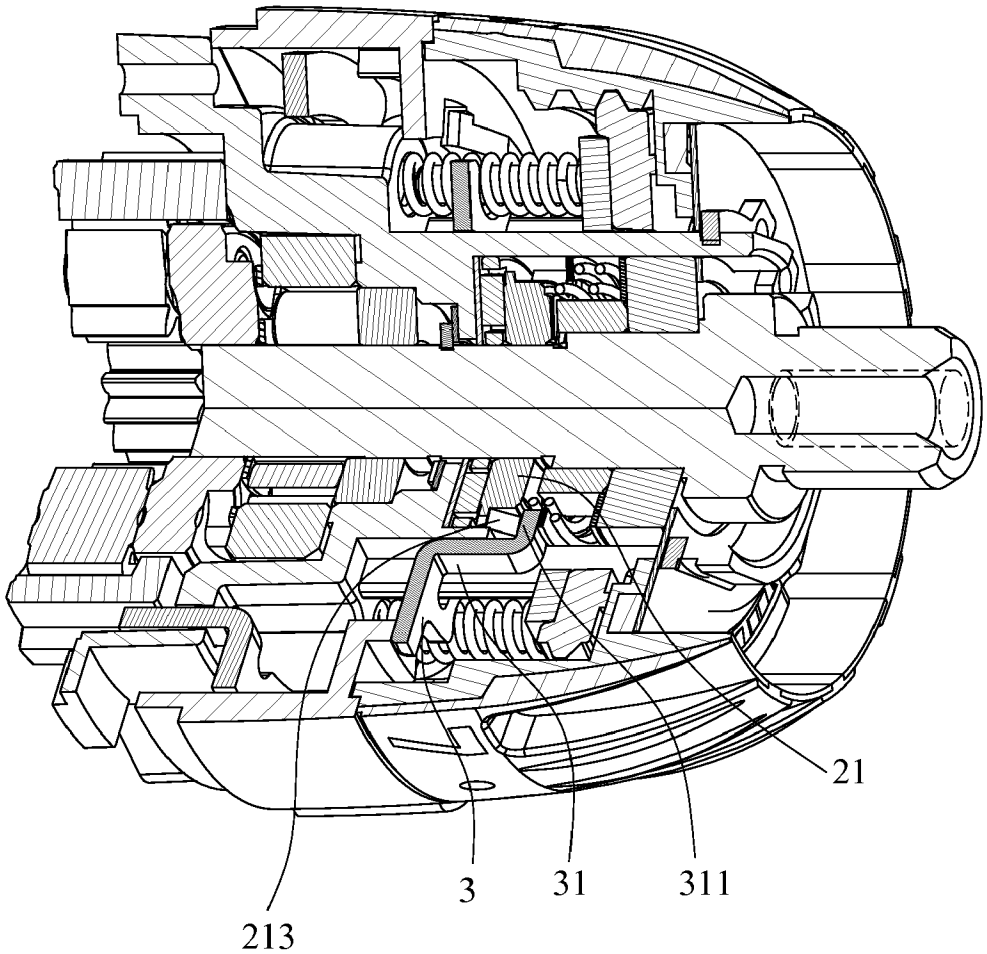
FIG. 4 is a cross-sectional view showing the output device according to the present invention, wherein the extensions of the locking member move along the inclined surface of the stationary ratchet gear.

Referring to FIG. 4, when the extensions 311 of the locking member 3 are engaged with the ribs 212 of the stationary ratchet gear 21, gaps are defined between the extensions 311 and the ribs 212. At the state that the extensions 311 of the locking member 3 are engaged with the ribs 212 of the stationary ratchet gear 21, when the switch ring 72 is switched to a third position to rotate the output shaft 11 in the reverse direction, due to the gap and the inclined surface 213, the extensions 311 move along the inclined surface 213 and the locking member 3 moves along the axial direction. Then, the extensions 311 are disengaged from the ribs 212 and the stationary ratchet gear 21 is released from being fixed. Because the stationary ratchet gear 21 is no longer fixed, the stationary ratchet gear 21 is rotated in the reverse direction with the movable ratchet gear 13. The movable ratchet teeth 131 do not move over the stationary ratchet teeth 211 and therefore there is no axial vibration. The stationary ratchet teeth 211 and the movable ratchet teeth 131 are protected from being damaged by the stress.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An output device for a power tool which has a protection mechanism, comprising:

an output unit having an output shaft, a first bearing and a movable ratchet gear connected to the output shaft, the movable ratchet gear having a plurality of movable ratchet teeth disposed on a side surface thereof;

a first spring connected to the output shaft;

a second spring connected to the output shaft;

a locking member having at least one pawl which has an extension;

a stationary ratchet gear unit having a stationary ratchet gear and a second bearing, the stationary ratchet gear and the second bearing connected to the output shaft, the stationary ratchet gear having a plurality of stationary ratchet teeth disposed at a side surface thereof, the stationary ratchet gear having a plurality of ribs disposed on a circumferential surface thereof and each rib having an inclined surface, an inclination of the inclined surface being smaller than inclinations of a forward rotation side and a reverse rotation side of the stationary ratchet teeth;

a case having a space and the first bearing being connected to an inside of the space; and a control unit having a knob, a switch ring and a nut, the nut having outer threads and the knob having inner threads which are threadedly connected to the outer threads;

wherein two ends of the first spring are respectively pressed against the first bearing and the locking member, two ends of the second spring are respectively pressed against the first bearing and the stationary ratchet gear, a spring washer has a side pressed against the nut, the switch ring is operated to move the locking member along an axial direction of the case making the extension of the pawl be engaged with or disengaged from the ribs of the stationary ratchet gear, when the extension is disengaged from the ribs, the output shaft outputs power in a form of pure rotation in a forward direction or a reverse direction; when the extension is engaged with the ribs, the output shaft outputs power in a forms of rotation in the forward direction combined with an axial vibration, when the output shaft rotates in the reverse direction, the inclined surface pushes the extension away from the ribs and the output shaft outputs power in a form of rotation in the reverse direction without the axial vibration.

2. The output device as claimed in claim 1, wherein the locking member comprises two pawls located diametrically opposite to each other and the extension extends inward.

* * * * *